US006782786B2

(12) United States Patent
Hoshino

(10) Patent No.: US 6,782,786 B2
(45) Date of Patent: Aug. 31, 2004

(54) ELECTRIC PUNCH

(75) Inventor: Hiroyasu Hoshino, Tokyo (JP)

(73) Assignee: KTF Corporation, Tokyo (JP)

( * ) Notice: Subject to any disclaimer, the term of this patent is extended or adjusted under 35 U.S.C. 154(b) by 80 days.

(21) Appl. No.: 10/306,584

(22) Filed: Nov. 27, 2002

(65) Prior Publication Data

US 2003/0131705 A1 Jul. 17, 2003

(30) Foreign Application Priority Data

Nov. 30, 2001 (JP) ..... 2001-367418

(51) Int. Cl.[7] ..... B26D 5/08

(52) U.S. Cl. ..... 83/620; 83/633; 83/684; 83/692; 83/698.41

(58) Field of Search ..... 83/684, 620, 686, 83/692, 693, 883, 694.41, 628, 633, 687, 691

(56) References Cited

U.S. PATENT DOCUMENTS 4,987,811 A * 1/1991 Ikarashi et al. ..... 83/372
6,269,721 B1 * 8/2001 Tseng ..... 83/618
6,374,715 B1 * 4/2002 Takatsuka ..... 83/620
6,540,451 B1 * 4/2003 Mori ..... 408/135
6,622,601 B2 * 9/2003 Hashimoto et al. ..... 83/146

* cited by examiner

*Primary Examiner*—Allan N. Shoap
*Assistant Examiner*—Phong Nguyen
(74) *Attorney, Agent, or Firm*—Anderson Kill & Olick; Eugene Lieberstein; Michael N. Meller

(57) ABSTRACT

An electric punch for automatically punching holes in documents and the like is provided that allows the spacing between the holes to be selectively set at either 70 mm (U.S. standard) or 80 mm (European and Japanese standard) by forming a bend midway of the length of operating arms of respective perforating members so that forward and rearward portions of the operating arms are laterally offset in parallel by a prescribed distance and clamping the operating arms with two supports of different width, thereby enabling the punched hole spacing to be selectively changed by exchanging the left and right perforating members.

11 Claims, 3 Drawing Sheets

ELECTRIC PUNCH

BACKGROUND OF THE INVENTION

1. Field of the Invention

The present invention relates to an electric punch for punching holes in documents and other sheet materials for filing, particularly to an electric punch enabling the hole spacing to be selectively set at 70 mm or 80 mm merely by changing the position of constituent components.

2. Description of Related Art

Punches are commonly used as perforating devices for forming holes in documents and other sheet materials to be filed. Both manual and electric (electrically powered) punches are available. Although the manual punch is more widely used, it requires considerable force to operate when punching a thick stack of sheets and also requires the center of each stack in the binding direction to be marked by creasing the uppermost document at the middle. The electric punch is more convenient because it can carry out punching automatically driven by electric power. A typical electric punch is the one taught by Japanese Patent No. 1967332.

The electric punch taught by this patent has a main frame that is equipped with left and right punch holes and under the punch holes with a catcher for collecting chad (punchings) and is formed at its left and right portions with guide holes that communicate with the left and right punch holes. The electric punch further has left and right supports, each having an insertion slot for paper sheet insertion, that are installed between the left and right guide holes and punch holes; left and right perforating members installed to be vertically movable within the guide holes of the left and right supports and having perforating blades at their lower ends; left and right operating arms extending fore to aft that are mounted at upper portions of the left and right supports to be vertically swingable and that rotatably support the upper ends of the left and right perforating members at their forward ends; and a rotating shaft that is mounted on the main frame to extend laterally, is rotated by the output of an electric motor and rotates the left and right operating arms to swing vertically. The left and right operating arms are formed at their rear side portions with long guide grooves that are long in the fore-aft direction. The operating arm on one side is formed at the front top of its long guide groove with a guide slot that communicates with the long guide groove. The rotating shaft has rotating disks attached to its opposite ends. Operating pins rotatably inserted in the long guide grooves are provided to project axially from eccentric positions of the right and left rotating disks with their phases offset in the rotating direction of the rotating disks. One operating pin is engaged with the guide slot communicating with the long guide groove of the operating arm on one side to put the perforating blade of one perforating member in standby state above the insertion slot. The other operating pin is inserted in the long guide groove of the operating arm at a midway position thereof to put the perforating blade of the other perforating member in standby state above the insertion slot.

One disadvantage of this conventional electric punch is its large size, which makes it heavy and difficult to carry about. Another is that while the spacing between the punched holes can be set at 70 mm or 80 mm, this requires a spacer (a separate component) to be fitted on the rotating shaft for width adjustment, which involves extensive disassembly.

A need has therefore been felt for an electric punch that is compact and light in weight and enables the hole spacing to be changed with ease.

The object of the present invention is to overcome the foregoing problems by providing a thin, compact and lightweight electric punch that utilizes bent perforating member operating arms to enable selective setting of the punched hole spacing at 70 mm or 80 mm by exchanging the left and right operating arms, without utilizing any separate component.

SUMMARY OF THE INVENTION

In order to achieve the above purpose, the present invention provides an electric punch comprising: a drive section; left and right perforating members installed on opposite sides of the drive section each including a perforating blade and an operating arm; punch holes for passage of the perforating members; and at least one chad catcher for collecting punchings produced by the perforating members; the electric punch being adapted to punch two holes in a stack of sheets inserted between the perforating members and the punch holes, wherein: a bend is formed midway of the length of the operating arm of each perforating member so that forward and rearward portions of the operating arm are laterally offset in parallel by a prescribed distance and the operating arms are clamped with two supports of different width, thereby enabling punched hole spacing to be selectively set at 70 mm (U.S. standard) and 80 mm (European and Japanese standard) by exchanging the left perforating member and the right perforating member.

The operating arms can be constituted as long and slender plate members bent into a crank-like shape. Moreover, the operating arms can be given a length nearly equal to that of the electric punch and the diameter of the rotating disks can be made small.

A configuration can be adopted wherein the center-to-center spacing between the punch holes of the perforating members can be set at either 70 mm (U.S. standard) or 80 mm (European and Japanese standard) by moving each of the left and right perforating members 40 to the opposite side of the drive section. Engagement members for engaging long holes of the operating arms can be provided to project from right and left rotating disks at identical phase locations to enable simultaneous initiation of punching operation and simultaneous hole punching on the left and right sides.

Since the electric punch according to the present invention thus makes it possible to exchange the right and left operating arms and their associated supports, it enables the spacing between the punched holes to be changed between 70 mm (U.S. standard) and 80 mm (European and Japanese standard) without need for any additional component. A thin, compact and lightweight electric punch can be provided by locating the drive section at the center, maximizing the length of the operating arms, and minimizing the diameter of the rotating disks.

DESCRIPTION OF THE PREFERRED EMBODIMENTS

Figure 3:
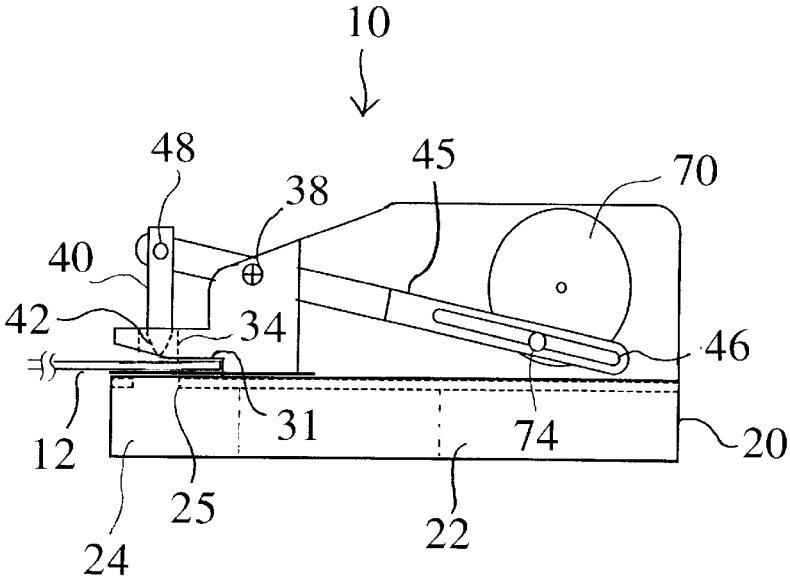
FIG. 3 is a side view of the invention electric punch.
Figure 4:
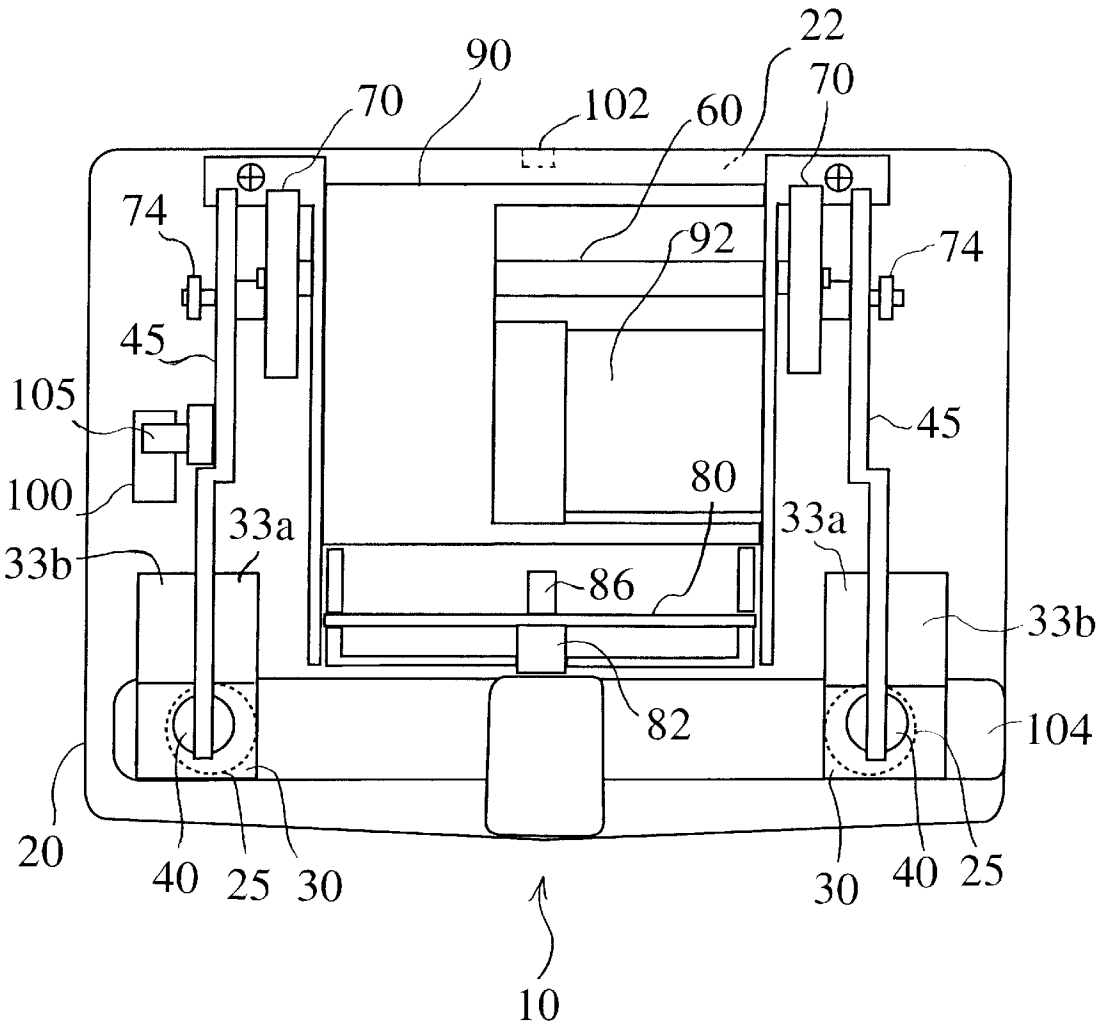
FIG. 4 is a plan view of the invention electric punch with the hole spacing set at 80 mm.

An electric punch that is an embodiment of the present invention will now be explained with reference to the drawings. FIGS. 12 and 3 are respectively a plan view, front view and side view of the electric punch with the hole spacing set at 70 mm. FIG. 4 is a plan view of the electric punch with the hole spacing set at 80 mm.

Figure 1:
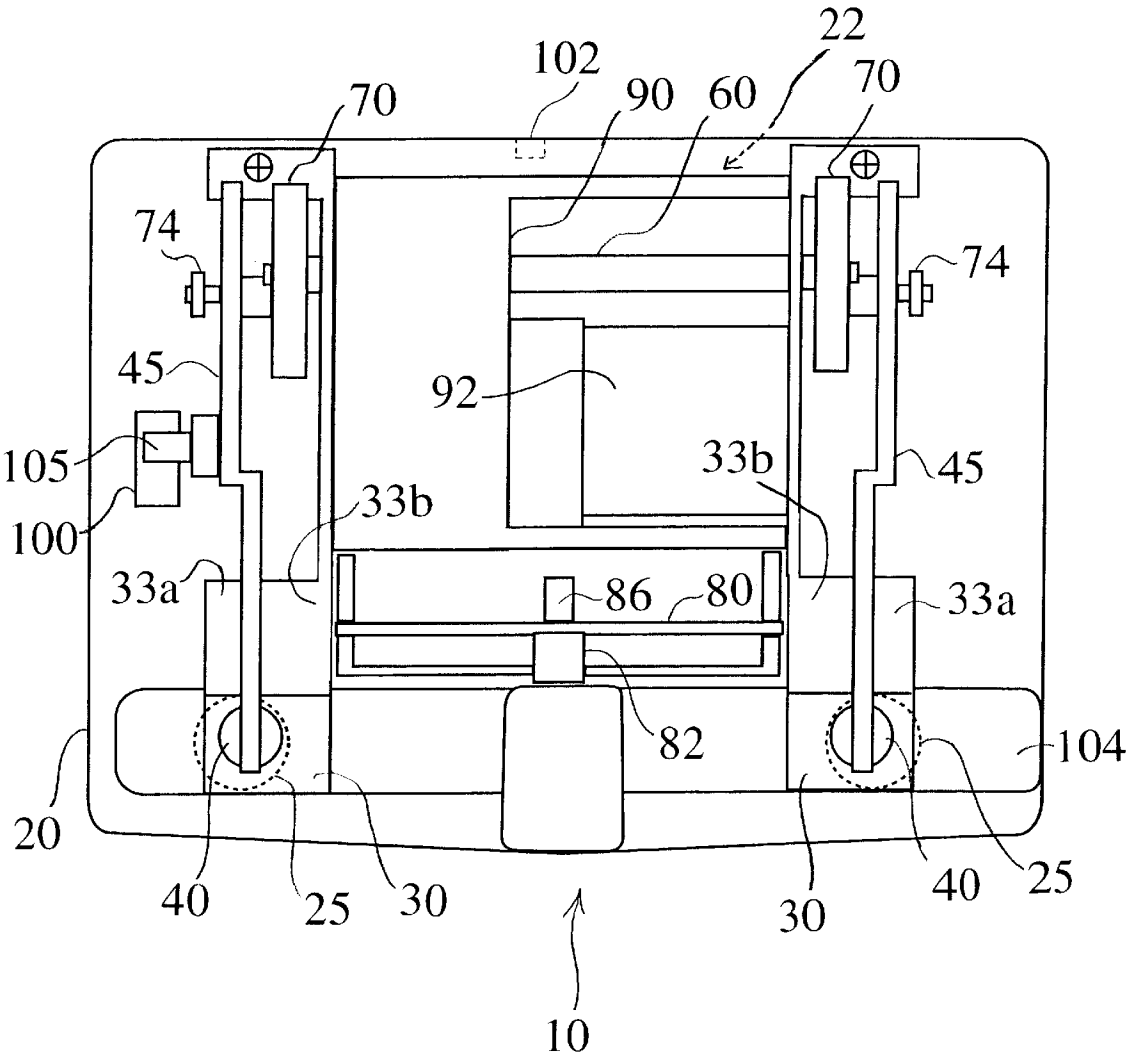
FIG. 1 is a plan view of an invention electric punch with the hole spacing set at 70 mm.
Figure 2:
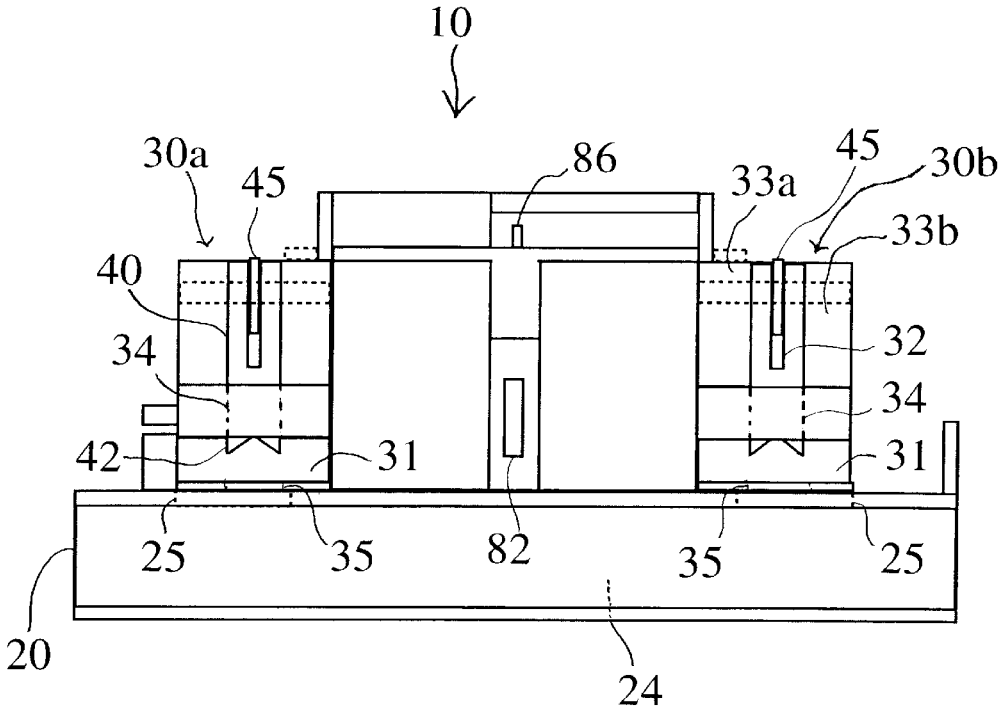
FIG. 2 is a front view of the invention electric punch.

As shown in FIGS. 1 and 2, the electric punch 10 according to the present invention comprises a main frame 20, supports 30, perforating members 40 and a drive section 90.

The main frame 20 is composed of a battery box 22, chad catcher 24 and the drive section 90, which includes a motor 92. The battery box 22 is a case for accommodating a battery or batteries used as an electrical power source. It is provided with an openable cover 23.

The chad catcher 24 is a case for collecting paper scraps produced when perforating documents and the like, i.e., chad in the shape of the holes punched in a sheet stack 12 (FIG. 3). Perforating blades 42 form holes 35 in the sheet stack from the top downward and pass through holes 25 in the frame to carry the chad produced into the chad catcher 24.

The motor 92 is installed in the drive section 90 and driven by power supplied from the battery through a receptacle.

The drive section 90 includes the motor 92 and a number of gears (not shown) through which the power from the motor is transmitted to a rotating shaft 60.

The electric punch of the present invention comprises the drive section 90, the left and right perforating members 40 composed of the perforating blades 42 and operating arms 45 installed on opposite sides of the drive section 90, the punch holes 35 through which the perforating members 40 pass, and the chad catcher 24 for collecting chad punched out by the perforating members 40. It punches two holes in a sheet stack inserted between the perforating members 40 and the punch holes 35. The spacing between the two punch holes can be selectively set at 70 mm (U.S. standard) or 80 mm (European and Japanese standard) by exchanging the left perforating member 40 and the right perforating member 40. This is enabled by forming a bend at the center of the length of the operating arm 45 of each perforating member 40 so that the forward and rearward halves of the operating arm 45 are laterally offset in parallel by a prescribed distance and by clamping the operating arms 45 with two supports 30 of different width.

The operating arms 45 can be bent in the manner of a crank. Further, the center-to-center spacing between the punch holes 35 of the perforating members 40 can be set at either 70 mm (U.S. standard) or 80 mm (European and Japanese standard) by moving each of the left and right perforating members 40 to the opposite side of the drive section 90.

Each of the supports 30 (separately designated 30*a* and 30*b*) comprises an insertion slot 31 for inserting documents or the like, an engagement groove 32, support pieces 33*a*, 33*b*, a guide hole 34, and the punch hole 35. Reversing the left support 30*a* and the right support 30*b* enables selection between the U.S. standard (70 mm) and the European/Japanese standard (80 mm).

The engagement grooves 32 are for engaging the operating arms 45 and are enclosed by the support pieces 33*a*, 33*b*. Each support piece 33*a* and its associated support piece 33*b* are given different widths so as that the spacing between the punched holes can be changed. The support pieces 33*a*, 33*b* are formed with pin insertion holes. Since each operating arm 45 and the associated support 30 are joined by pin using the pin insertion holes, the operating arms 45 can operate by swing about the pin insertion holes.

Each perforating member 40 is constituted of the associated perforating blade 42 mounted at its tip and the associated operating arms 45 formed as a long and slender plate member. The perforating blades 42 are operated to produce punched holes for document binding in the sheet stack (document) 12 by moving the perforating blades 42 vertically. The operating arm 45 of each perforating member 40 is engaged with the engagement groove 32 of the associated support 30, and the perforating blade fits in the punch hole 35 to be vertically movable therein.

The perforating blades 42 are circular blades that pass through the sheet stack 12 inserted into the insertion slot from the top downward, thereby producing punched holes in the sheets of the stack. The punchings (chad) produced from the punched holes during document punching are pushed to the bottom of the holes in the main frame 20 by the perforating blades 42 to pass through the punch holes 35 and the holes 25 and be collected in the chad catcher 24.

As shown in FIG. 3, each operating arm 45 is a long and slender member engaged with a rotating disk 70 and the associated support 30. The associated perforating blade 42 is mounted at its tip to be vertically movable. The rearward part of the operating arm 45 is formed with a long hole 46 of a length substantially equal to the diameter of the rotating disk 70 The long hole 52 engages with an engagement member 74 including a projection formed on the rotating disk 70.

Owing to the engagement of the tip of the engagement member 74 projecting from the rotating disk 70 with the long hole 46 of the operating arm, rotational motion of the rotating disk 70 is converted to vertical (reciprocal up-down) motion to move the perforating blade mounted on the tip of the operating arm vertically. Since the operating arms 45 are engaged with the supports 30 by pins 48, leverage is produced about the pin, which act as fulcrums during the vertical motion. Therefore, when the rear ends of the operating arms 45 are lifted, the perforating members 40 mounted at their tips are forced downward to punch holes in the sheet stack 12. Moreover, owing to the fact that the length of the operating arms is maximized (is set to nearly the same length as that of the electric punch unit), the sheet stack 12 can be simultaneously punched on the left and right sides by a smaller rotational driving force than heretofore. In addition, since the principle of the lever is utilized, the diameter of the rotating disks can be reduced to realize a thinner (lower profile) unit.

The rotating shaft 60 transmits the rotational motion of the drive section 90 to the rotating disks 70, i.e., it serves as the center shaft for rotating the rotating disks 70.

The rotating disks 70 transmit the rotational motion of the drive section 90 to the exterior. They are engaged with the rotating shaft 60 and the operating arms 45 and utilize the engagement of the rotating shaft projections with the operating arms to transmit the rotational motion of the rotating shaft 60 to the operating arms 45 as vertical motion. Despite their small diameter, the rotating disks are able to produce sufficient punching force thanks to the leverage obtained owing to the long length of the operating arms. In addition, the small diameter of the rotating disks makes it possible to hold down the height of the electric punch unit and thus achieve a piece of equipment with a thin overall profile. Since the electric punch is therefore smaller and thinner than conventional units, it can be stored in a desk drawer.

When the rotating disks 70 rotate, the rotational motion is converted to vertical motion for moving the tips of the operating arms 45 up and down.

A switch panel 80 is installed on the front face of the drive section 90 in this embodiment. It is equipped with an insertion slot operation switch 82 and a reset switch 86 consisting of transistors, capacitors and the like. When the sheet stack 12 inserted into the insertion slot 31 presses onto the operation switch 82, the switch turns ON to supply current for rotating the motor 92 of the drive section 90. The torque produced by the motor 92 of the drive section 90 is transmitted to the rotating disks 70, thereby starting the punching operation. In normal operation, one revolution of the rotating disks makes the perforating blades 42 move up and down one time and restores the switch to the OFF condition.

If the punching operation should stop midway owing to excessive thickness or resistance of the sheet stack, an undesirable condition in which load continues to be constantly applied will arise because the operation switch 82 remains ON. The reset switch 86 is provided for restoring the perforating blades 42 to their original positions when such a malfunction occurs. Specifically, when the punching operation stops midway, the operator presses the reset switch 86. As a result, the motor 92 rotates backwards to rotate the rotating disks 70 in reverse and restore the operating arms 45 from the partially completed punching position to their position before the start of the punching operation.

The drive section 90 uses AC or DC power to produce rotational motion. In this embodiment, it is equipped with the battery-driven motor 92. The foregoing explanation of this embodiment assumes that the motor 92 provided in the drive section 90 for producing rotational motion is driven by a battery (dc) power source. The invention is not limited to this arrangement, however, and it is possible instead to use a motor driven by an ac power source. The drive section 90 is equipped with the motor 92 and gears (not shown) for continuously transmitting the rotational motion of the motor. The driving force of the motor is transmitted to the rotating shaft 60 through the gears. In this embodiment, the drive section is compactly installed at the center of the electric punch 10. The height of the electric punch 10 can therefore be minimized to realize a unit that is much more compact in overall size than the conventional electric punch. As a result, an electric punch that can be easily stored in a desk drawer can be realized, which has not been possible heretofore.

A limit position switch 100 is provided on the main frame 20 to stop the rotation of the engagement points between the rotating disks 70 and the operating arms 45 after one revolution. In addition, an AC terminal connector 102 is installed on the back of the main frame 20 for enabling connection to an AC power source. A center guide 104 is further provided for facilitating perforation of documents and sheet stacks of different sizes.

The limit position switch 100 is pressed by an engagement projection 105 formed on one of the operating arms 45. When the rotating disks 70 and the operating arms 45 have completed one revolution (cycle) following initiation of operation by the operation switch 82, the engagement projection 105 provided on the operating arm 45 presses the limit position switch 100. The electrical configuration is such that when the limit position switch 100 is pressed, the rotating disks 70 and operating arms 45 are restored to their initial positions. The location of the limit position switch 100 and the location of the engagement projection 105 on the operating arm 45 can be selected as desired insofar as they are selected such that engagement projection 105 presses the limit position switch 100 on completion of one revolution of the rotating disks 70.

When the electric punch is utilized, the operator first inserts a stack of (paper) sheets into the insertion slot 31. The leading edge of the inserted sheet stack presses against the operation switch 82, which turn□ ON to initiate electric punch operation. Specifically, the motor 92 operates to rotate the rotating shaft 60 through the gear train (not shown) of the drive section 90. The rotating shaft 60 in turn rotates the rotating disks 70. The engagement members 74 formed on the rotating disks 70 rotate along circular paths together with the rotating disks 70. Owing to the engagement of the engagement members 74 with the long holes 46 of the operating arms 45, the circular motion of the engagement members 74 is converted into vertical motion of the operating arms 45.

Since the operating arms 45 are rotatably supported on the supports 30 by pins 38, leverage operates around the pins 38 as fulcrums. The up and down motion of the portion of the operating arms 45 reward of the pins 38 lowers and raises the perforating blades 42 mounted at the tips of the operating arms 45, thereby punching holes in the sheet stack.

The standard punched hole spacing is 70 mm in the United States and 80 mm in Japan and Europe. When manufacturing an electric punch for the U.S. market, therefore, the bends of the operating arms 45 are oriented so that the forward ends of operating arms 45 are situated closer to the drive section 90, as shown in FIG. 1. On the other hand, when an electric punch with 80-mm punched hole spacing is to be manufactured, the supports 30*a*, 30*b* are exchanged so that the support 30*b* is located on the left side and the support 30*a* on the right side as shown in FIG. 4. Conventional production of electric punches adapted to the two standards has required the fabrication and installation of different components depending on the country to which the electric punch is to be shipped. Differently from this, the electric punch according to this embodiment can be easily adapted to either standard without need for fabrication and installation of different components, simply by installing components common to both standards at reversed locations.

Specifically, the hole spacing can be changed between the two standards merely by exchanging the set of the support 30 and operating arm 45 one side with the set on the other side.

As explained in the foregoing, the electric punch according to the present invention can automatically conduct hole punching by electrical operation and, in addition, enables selection between 70 mm and 80 mm punched hole spacing without need for any additional component. Specific advantages offered include:

1. Since reversal of the left and right supports enables simple selection between two punched hole spacings, electric punches suitable for export to any part of the world can be assembled with no increase in number of components that have to be fabricated.
2. The crank-like shape of the operating arms makes it easy to exchange them between the left and right sides, while the fact that they are similarly shaped components that can nevertheless be exchanged between the left and right sides advantageously reduces the number of different components required.
3. Owing to the extended length of the operating arms, a leverage effect is achieve that enables a small rotational driving force produced electrically to punch holes on both the left and right simultaneously and even to punch multiple sheets in a single stack.
4. Since the drive section is centralized near the middle of the electric punch, the electric punch can be made thinner and considerably more compact than the conventional electric punch.

5. The punched hole spacing can be freely selected (changed) between 70 mm (U.S. standard) and 80 mm (European and Japanese standard) simply by installing one and the same components at reverse locations.
6. The ability of the perforating members to simultaneous punch holes on the left and right helps to reduce unit size while also ensuring stable punching operation.

What is claimed is:

1. An electric punch comprising:

a drive section;

left and right perforating members installed on opposite sides of the drive section each including a perforating blade and an operating arm;

punch holes for passage of the perforating members; and at least one chad catcher for collecting punchings produced by the perforating members;

the electric punch being adapted to punch two holes in a stack of sheets inserted between the perforating members and the punch holes, wherein:

a bend is formed midway of the length of the operating arm of each perforating member so that forward and rearward portions of the operating arm are laterally offset in parallel by a prescribed distance and the operating arms are clamped with two supports of different width, thereby enabling punched hole spacing to be selectively set at 70 mm (U.S. standard) and 80 mm (European and Japanese standard) by exchanging the left perforating member and the right perforating member.

2. An electric punch according to claim 1, wherein the operating arms are long and slender plate members bent into a crank-like shape enabling parallel motion of the forward and rearward portions along a center line.

3. An electric punch according to claim 1, wherein the operating arms are given a length nearly equal to that of the electric punch and the diameter of the rotating disks is made small.

4. An electric punch according to claim 1, wherein the center-to-center spacing between the punch holes of the perforating members can be set at either 70 mm (U.S. standard) or 80 mm (European and Japanese standard) by moving each of the left and right perforating members 40 to the opposite side of the drive section.

5. An electric punch according to claim 1, wherein engagement members for engaging long holes of the operating arms are provided to project from right and left rotating disks at identical phase locations to enable simultaneous initiation of punching operation and simultaneous hole punching on the left and right sides.

6. An electric punch according to claim 2, wherein the operating arms are given a length nearly equal to that of the electric punch and the diameter of the rotating disks is made small.

7. An electric punch according to claim 2, wherein the center-to-center spacing between the punch holes of the perforating members can be set at either 70 mm (U.S. standard) or 80 mm (European and Japanese standard) by moving each of the left and right perforating members 40 to the opposite side of the drive section.

8. An electric punch according to claim 2, wherein engagement members for engaging long holes of the operating arms are provided to project from right and left rotating disks at identical phase locations to enable simultaneous initiation of punching operation and simultaneous hole punching on the left and right sides.

9. An electric punch according to claim 3, wherein the center-to-center spacing between the punch holes of the perforating members can be set at either 70 mm (U.S. standard) or 80 mm (European and Japanese standard) by moving each of the left and right perforating members 40 to the opposite side of the drive section.

10. An electric punch according to claim 3, wherein engagement members for engaging long holes of the operating arms are provided to project from right and left rotating disks at identical phase locations to enable simultaneous initiation of punching operation and simultaneous hole punching on the left and right sides.

11. An electric punch according to claim 4, wherein engagement members for engaging long holes of the operating arms are provided to project from right and left rotating disks at identical phase locations to enable simultaneous initiation of punching operation and simultaneous hole punching on the left and right sides.

* * * * *